US008336353B2

(12) United States Patent
Tsuritani

(10) Patent No.: US 8,336,353 B2
(45) Date of Patent: Dec. 25, 2012

(54) COIL SPRING MANUFACTURING MACHINE

(75) Inventor: Katsuhide Tsuritani, Osaka (JP)

(73) Assignee: Shinko Machinery Co., Ltd., Osaka (JP)

( * ) Notice: Subject to any disclaimer, the term of this patent is extended or adjusted under 35 U.S.C. 154(b) by 1001 days.

(21) Appl. No.: 12/068,522

(22) Filed: Feb. 7, 2008

(65) Prior Publication Data

US 2008/0302155 A1 Dec. 11, 2008

(30) Foreign Application Priority Data

Jul. 29, 2005 (JP) ..... 2005-221526
Jul. 6, 2007 (JP) ..... 2007-178332

(51) Int. Cl.
*B21F 3/02* (2006.01)

(52) U.S. Cl. ..... 72/145; 72/135; 72/140

(58) Field of Classification Search ..... 72/135, 72/138, 140, 142–145, 441, 442, 446, 447, 72/454

See application file for complete search history.

(56) References Cited

U.S. PATENT DOCUMENTS 5,937,685 A * 8/1999 Matsuoka et al. ..... 72/137
6,151,942 A * 11/2000 Itaya ..... 72/137
2004/0154365 A1* 8/2004 Tsuritani ..... 72/138
2004/0231384 A1* 11/2004 Tsuritani ..... 72/137

FOREIGN PATENT DOCUMENTS

JP 10-109133 A 4/1998
JP 11-000738 A 1/1999
JP 2000-61737 A 2/2000
JP 2004-237350 A 8/2004
JP 2005-28436 A 2/2005

OTHER PUBLICATIONS

Japanese Office Action for Application No. 2005-221526, dated Mar. 29, 2011.

* cited by examiner

*Primary Examiner* — Debra Sullivan
(74) *Attorney, Agent, or Firm* — Birch, Stewart, Kolasch & Birch, LLP

(57) ABSTRACT

Providing a coil spring manufacturing machine capable of adjusting the shape of a manufactured spring with fixing a wire feeding unit, followed by moving a shaping tool mounting member, attached to one or a plurality of movable members, in the front-rear, left-right, and/or up-down direction of the wire feeding direction. The shaping tool mounting member may be moved in all the three directions. Each movable member is provided with a drive source for driving the movable member.

2 Claims, 6 Drawing Sheets

COIL SPRING MANUFACTURING MACHINE

TECHNICAL FIELD

The present invention relates to a coil spring manufacturing machine capable of highly freely adjusting the relative positions of a wire feeding unit and a shaping tool mounting member.

BACKGROUND ART

A conventional coil spring manufacturing machine includes a wire processing space, which is a space where a wire is processed to form a coil spring, in the front wall of a housing, and a wire feeding unit having at least one pair of wire feeding rollers for feeding the wire frontward into the wire processing space from the rear side of the housing of the manufacturing machine. The wire fed into the wire processing space is bent with a bending die mounted on at least one shaping tool mounting member which is capable of advancing into and retreating from the wire processing space.

One or a plurality of shaping tool mounting members are placed in a direction crossing the wire running direction in the wire passage at a substantially right angle, and each shaping tool mounting member is provided with a motor as a drive source, or a power transmitting mechanism. It is possible to manufacture a coil spring with desired shape followed by controlling the rotation of the motor, and setting the locations of one or a plurality of shaping tool mounting members and the bending die.

The wire feeding unit disclosed in Japanese Patent Application Laid-Open No. 2005-028436 is mounted on a left-right movable base provided to be capable of moving in the left-right direction, and the left-right movable base is attached movably to a vertically movable base provided to be capable of moving in the vertical direction. The vertically movable base is movably attached to a front-rear movable base provided to be capable of moving in the front-rear direction. It is thus possible to three-dimensionally change the relative positions of the wire feeding unit and the shaping tool mounting member in the wire processing space.

SUMMARY OF THE INVENTION

However, the above-described coil spring manufacturing machine, in which the wire feeding unit is moved in the vertical direction, the left-right direction and the front-rear direction, is required to provide a large-scale moving mechanism on the wire feeding unit side. In particular, since the wire feeding unit moves in the front-rear direction, there is a problem that it is difficult to decrease the size of the housing for storing the wire feeding unit.

The present invention has been made with the aim of solving the above problem, and it is an object of the invention to provide a coil spring manufacturing machine being capable of adjusting the shape of a manufactured spring with fixing the wire feeding unit, followed by moving the shaping tool mounting members, attached to a plurality of movable members, in the front-rear direction or the vertical direction and the left-right direction.

Another object is to provide a coil spring manufacturing machine capable of adjusting the shape of a manufactured spring with fixing the wire feeding unit, followed by moving the shaping tool mounting members in the front-rear direction, the vertical direction and the left-right direction.

A coil spring manufacturing machine of the present invention comprises:

a wire feeding unit for feeding a wire into a wire processing space where the wire is processed to form a coil spring;

at least one shaping tool mounting member provided to be capable of advancing into and retreating from the wire processing space;

a movable member having the shaping tool mounting member attached thereto, and provided to be capable of moving in a wire feeding direction (front-rear direction); and a drive source for moving the movable member in the wire feeding direction, wherein the relative positions of the wire feeding unit and the shaping tool mounting member in the wire feeding direction are adjusted followed by controlling an operation of the drive source.

Moreover, a coil spring manufacturing machine of the present invention comprises in addition to the above-mentioned movable member capable of moving in the front-rear direction:

a plurality of movable members having at least one shaping tool mounting member being attached to any one of the movable members, and provided to be capable of moving in a first direction and a second direction which cross each other at a right angle and cross the wire feeding direction at a right angle;

a first drive source for moving a first movable member in the first direction (for example, the vertical direction); and a second drive source for moving a second movable member in the second direction (for example, the left-right direction), wherein the relative positions of the wire feeding unit and the shaping tool mounting member are adjusted followed by controlling operations of the first drive source and second drive source.

Further, a coil spring manufacturing machine of the present invention comprises:

a wire feeding unit, for feeding a wire into a wire processing space where the wire is processed to form a coil spring;

a plurality of movable members having at least one shaping tool mounting member attached to any one of the movable members, and provided to be capable of moving in a first direction and a second direction, the shaping tool mounting member provided to be capable of advancing into and retreating from the wire processing space;

a first drive source for moving a first movable member in the first direction (for example, the vertical direction); and a second drive source for moving a second movable member in the second direction (for example, in the left-right direction), wherein the relative positions of the wire feeding unit and the shaping tool mounting member are adjusted followed by controlling operations of the first drive source and second drive source.

The coil spring manufacturing machine of this invention does not include a movable member which moves in the front-rear direction.

The wire feeding direction is horizontal, the first (or second) direction is vertical, and the second (or first) direction is horizontal.

According to the present invention, the positional relationship between the wire feeding unit and the shaping tool mounting member is adjusted by moving the movable member in the wire moving direction. In this case, it is possible to avoid, the housing for storing the wire feeding unit from becoming larger in the front-rear direction, followed by providing the moving function member on the front side of the housing. Thus, it is possible to provide a compact coil spring manufacturing machine.

Further, in the present invention, the positional relationship between the wire feeding unit and the shaping tool mounting member is adjusted by controlling the operations of the first drive source for moving the first movable member in the first axis direction and the second drive source for moving the second movable member in the second axis direction. Hence, it is possible to fix the wire feeding unit and supply the wire in a stable manner, and it is possible to provide a mechanism for movement of the shaping tool mounting member in the first and second axis directions on the front side of the housing, thereby enabling a reduction in the size of the housing.

The above and further objects and features of the invention will more fully be apparent from the following detailed description with accompanying drawings.

DETAILED DESCRIPTION OF THE INVENTION

The following will explain the present invention, based on the drawings illustrating some embodiments.

Embodiment 1

Figure 1:
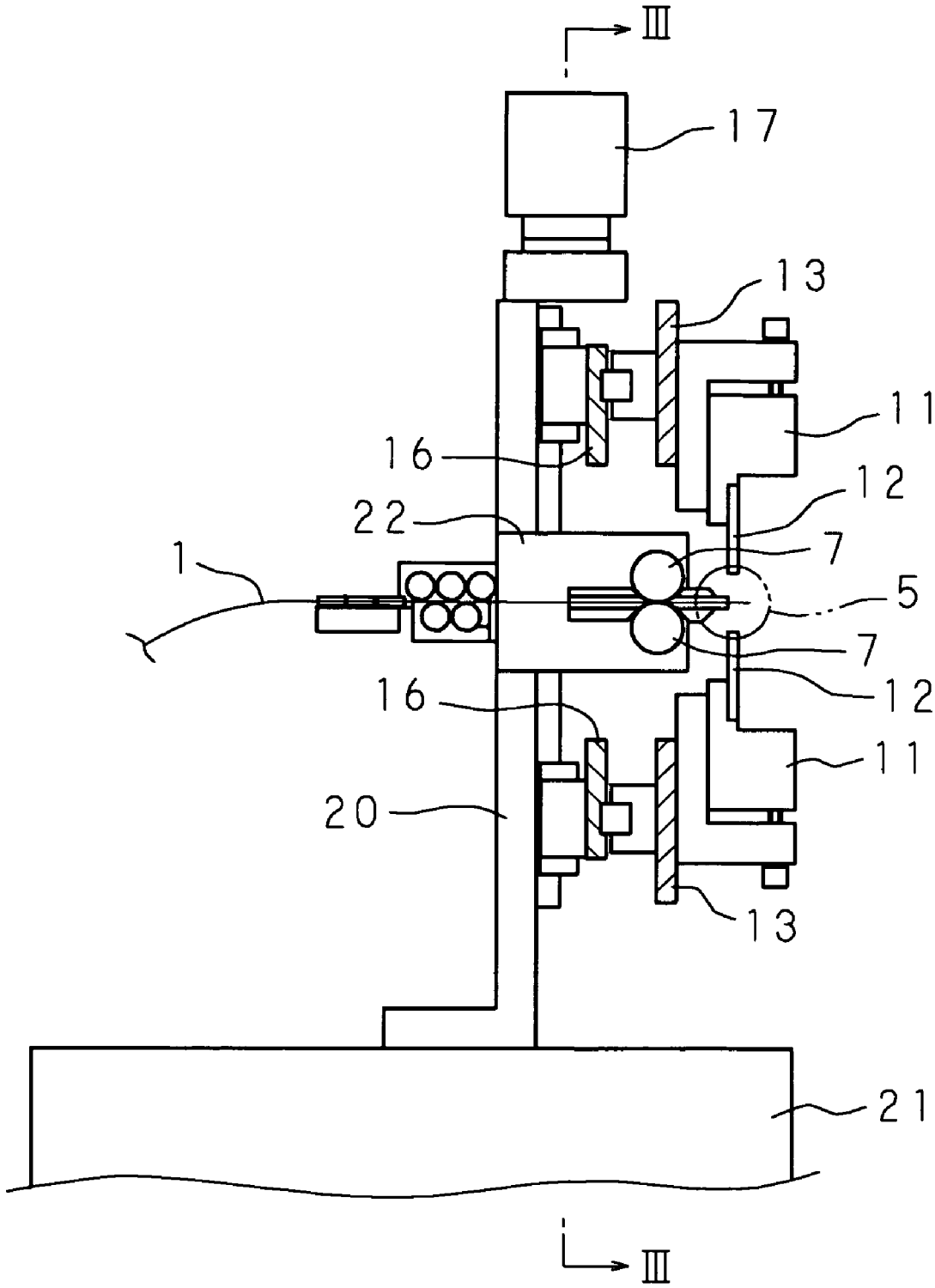
FIG. 1 is a cross sectional view taken along a vertical plane in the front-rear direction, including a wire feeding unit, and showing an essential structure of a coil spring manufacturing machine according to Embodiment 1.
Figure 2:
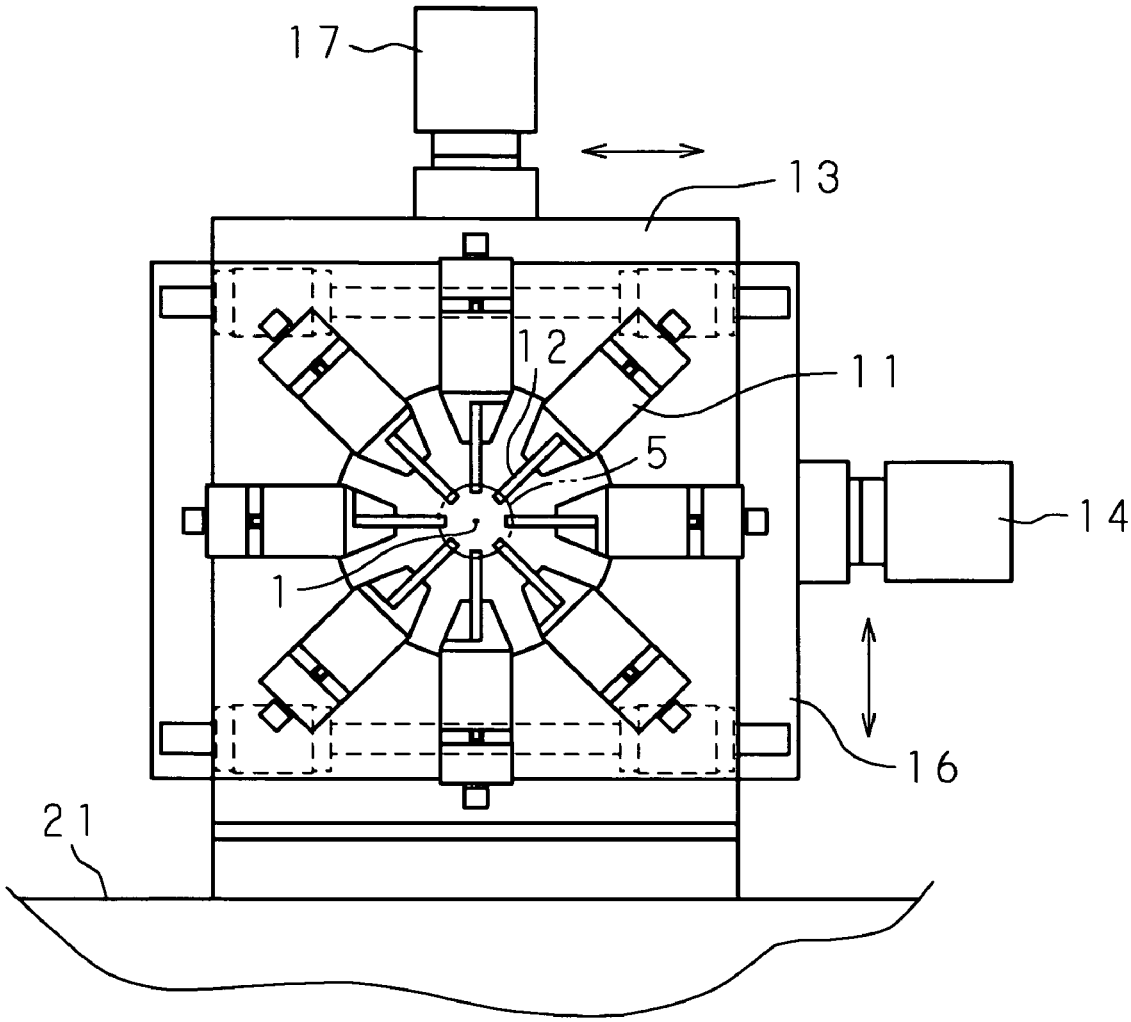
FIG. 2 is a front view showing the essential structure of the coil spring manufacturing machine according to Embodiment 1.
Figure 3:
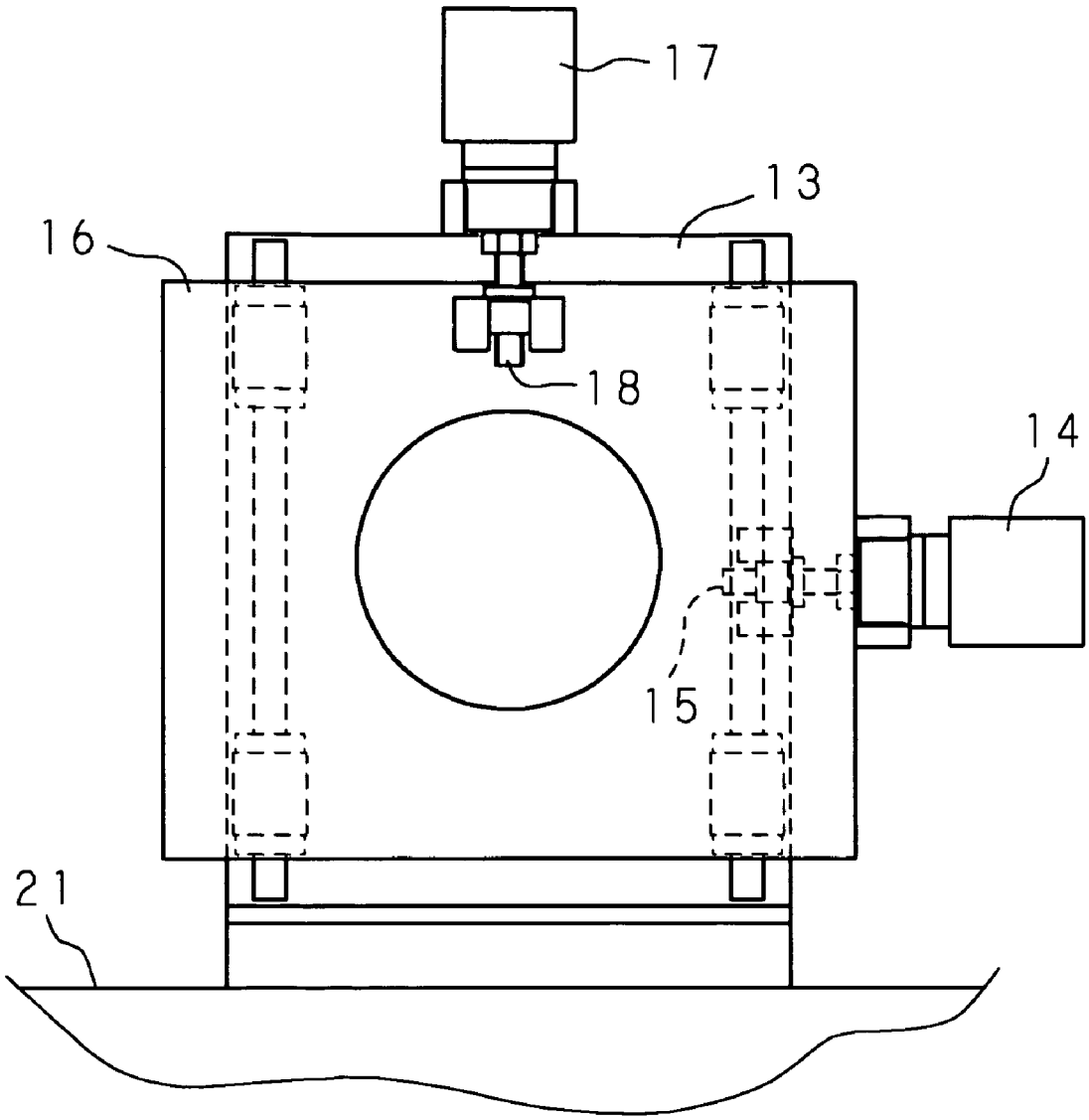
FIG. 3 is a cross sectional view taken along the III-III line in FIG. 1.

FIG. 1 is a cross sectional view taken along a vertical plane in the front-rear direction, including a wire feeding unit, and showing an essential structure of a coil spring manufacturing machine according to Embodiment 1, FIG. 2 is a front view showing the essential structure of the coil spring manufacturing machine according to Embodiment 1, and FIG. 3 is a cross sectional view taken along the III-III line in FIG. 1.

The spring manufacturing machine of Embodiment 1 feeds a wire 1 horizontally to the right in FIG. 1, that is, the front of the coil spring manufacturing machine, with rotations of a pair of two upper and lower wire feeding rollers 7, 7 of a wire feeding unit 22 mounted on a base member 20 shown in FIG. 1. The wire 1 thus fed into a wire processing space 5 comes into contact with shaping tools 12, 12, . . . (for example, bending dies) mounted on the ends of a plurality of shaping tool mounting members 11, 11, . . . placed to cross the direction of feeding the wire 1 at substantially right angles. The wire 1 is bent and deformed in desired directions, according to the angles of the shaping tools 12, 12, . . . in contact and their relative positional relationship, to bend and form a desired spring. Although Embodiment 1 illustrates an example including a plurality of shaping tool mounting members 11, 11, . . . , the coil spring manufacturing machine 1 may include at least one shaping tool mounting member 11.

The above-mentioned one or a plurality of shaping tool mounting members 11, 11, . . . are attached to a first plate member 13. The first plate member 13 provided to be movable in a lateral direction of the housing of the coil spring manufacturing machine, that is, a horizontal direction (hereinafter referred to as the X-axis direction) crossing the direction of feeding the wire 1 at a substantially right angle, and comprises a servo motor 14 as a drive source. The rotation of the servo motor 14 is converted into linear motion in the X-axis direction of the first plate member 13 by a ball screw 15.

The first plate member 13 is attached to a second plate member 16 so that it is movable in the X-axis direction. The second plate member 16 is provided to be movable in a direction crossing the movable direction of the first plate member 13 at a substantially right angle, that is, the vertical direction (hereinafter referred to as the Y-axis direction) of the housing of the coil spring manufacturing machine, and comprises a servo motor 17 as a drive source. The rotation of the servo motor 17 is converted into linear motion in the Y-axis direction of the second plate member 16 by a ball screw 18.

The second plate member 16 is attached to the base member 20 so that it is movable in the Y-axis direction. The base member 20 is attached to a board 21 of the spring manufacturing machine and has a wire feeding unit 22 attached near the center of the base member 20. Thus, the wire feeding unit 22 does not move, and it is possible to change the relative positions of the wire feeding unit 22 and the shaping tools 12, 12, . . . of the shaping tool mounting members 11, 11, . . . by moving the first plate member 13 and the second plate member 16 in the X-axis direction and the Y-axis direction, respectively.

Note that the mechanism for converting the rotation of the servo motor 14 into linear motion in the X-axis direction of the first plate member 13 and the mechanism for converting the rotation of the servo motor 17 into linear motion in the Y-axis direction of the second plate member 16 are not particularly limited, and any known conversion mechanisms may be used.

According to Embodiment 1, as described above, it is possible to fix the wire feeding unit 22 and supply the wire 1 in a stable manner, and it is possible to decrease the size of the housing by providing the mechanisms for movement in the vertical direction and lateral direction on the front side of the housing of the coil spring manufacturing machine.

EMBODIMENT 2

Figure 4:
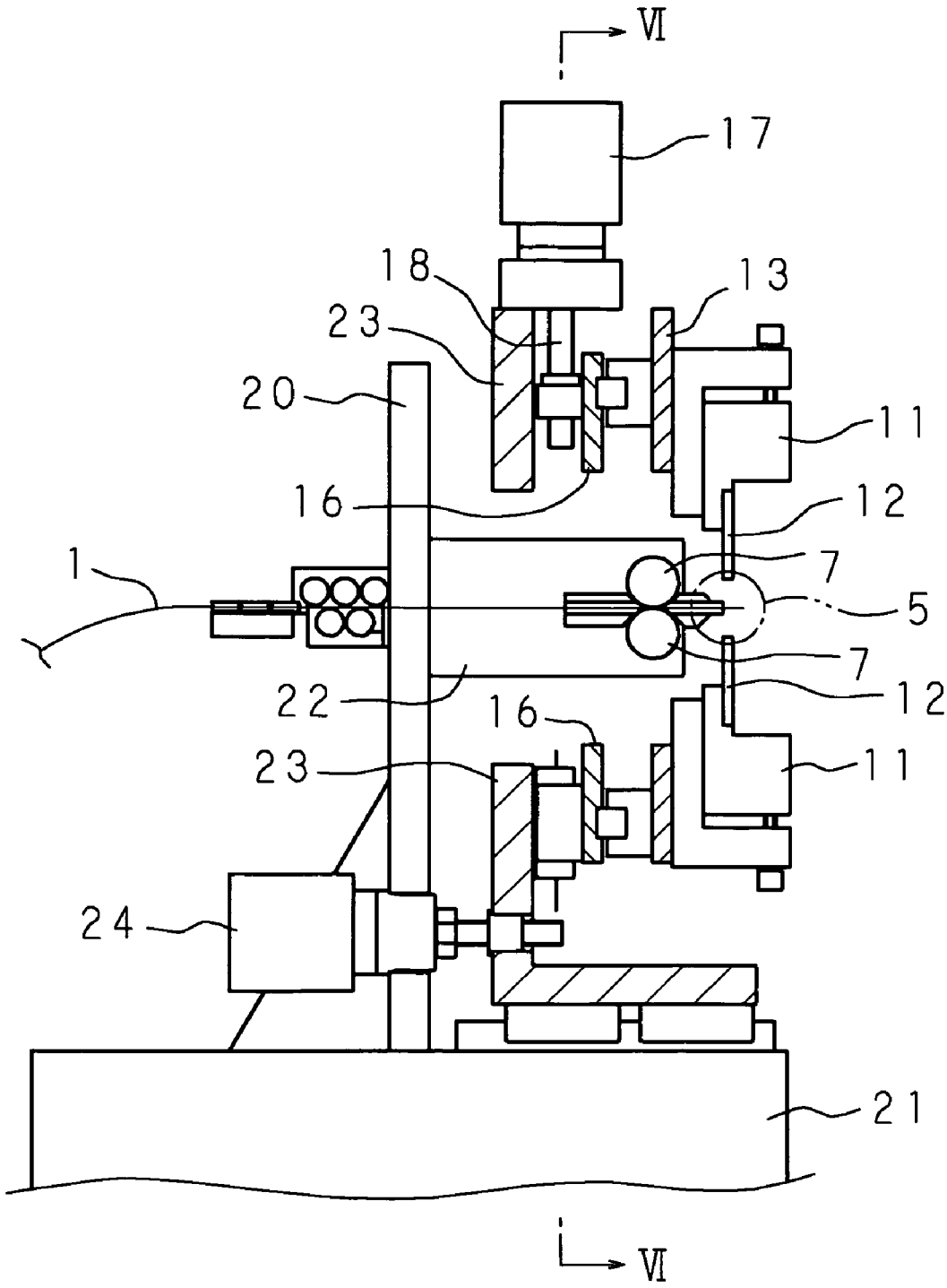
FIG. 4 is a cross sectional view taken along a vertical plane in the front-rear direction, including a wire feeding unit, and showing an essential structure of a coil spring manufacturing machine according to Embodiment 2.
Figure 5:
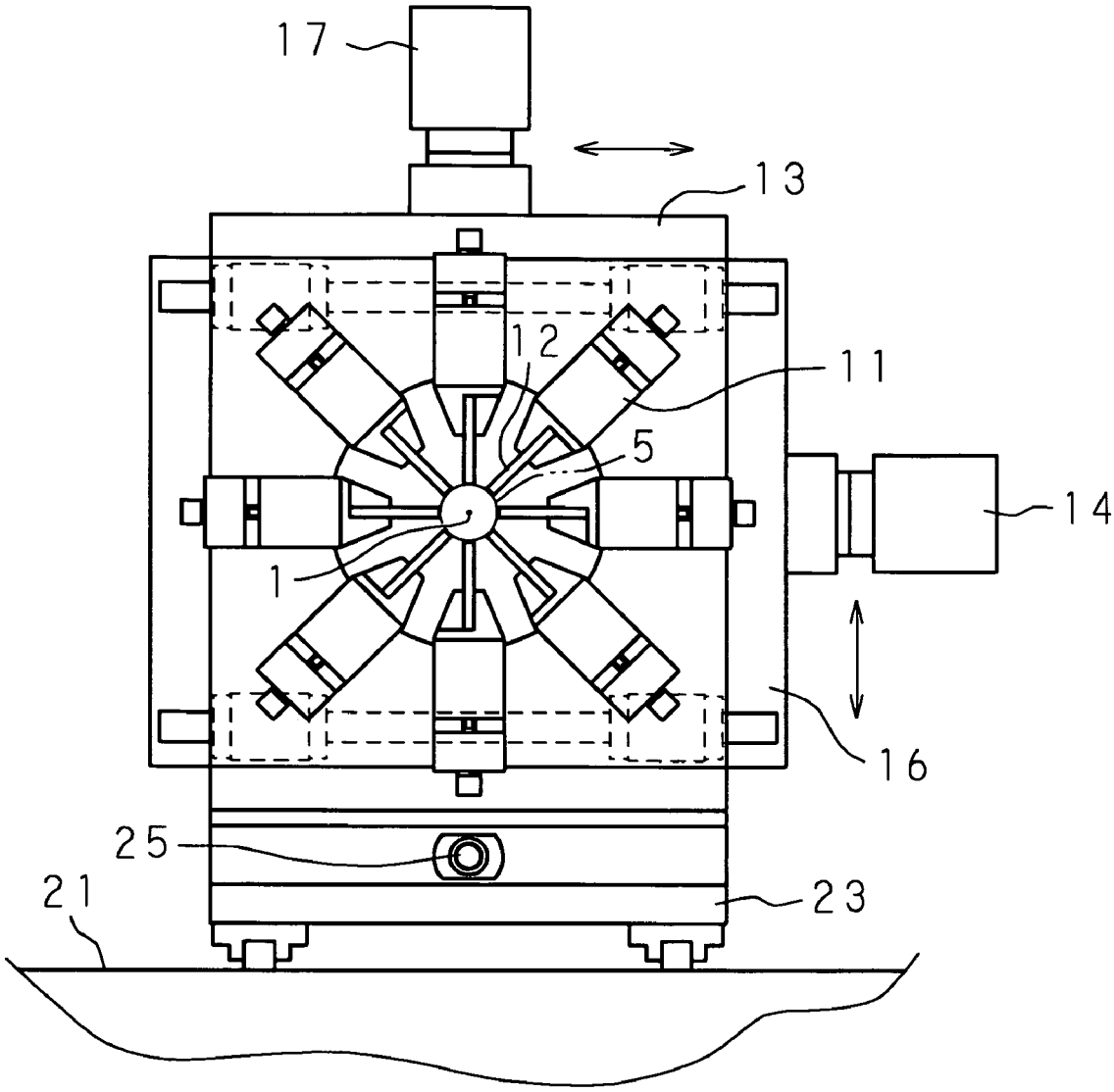
FIG. 5 is a front view showing the essential structure of the coil spring manufacturing machine according to Embodiment 2.
Figure 6:
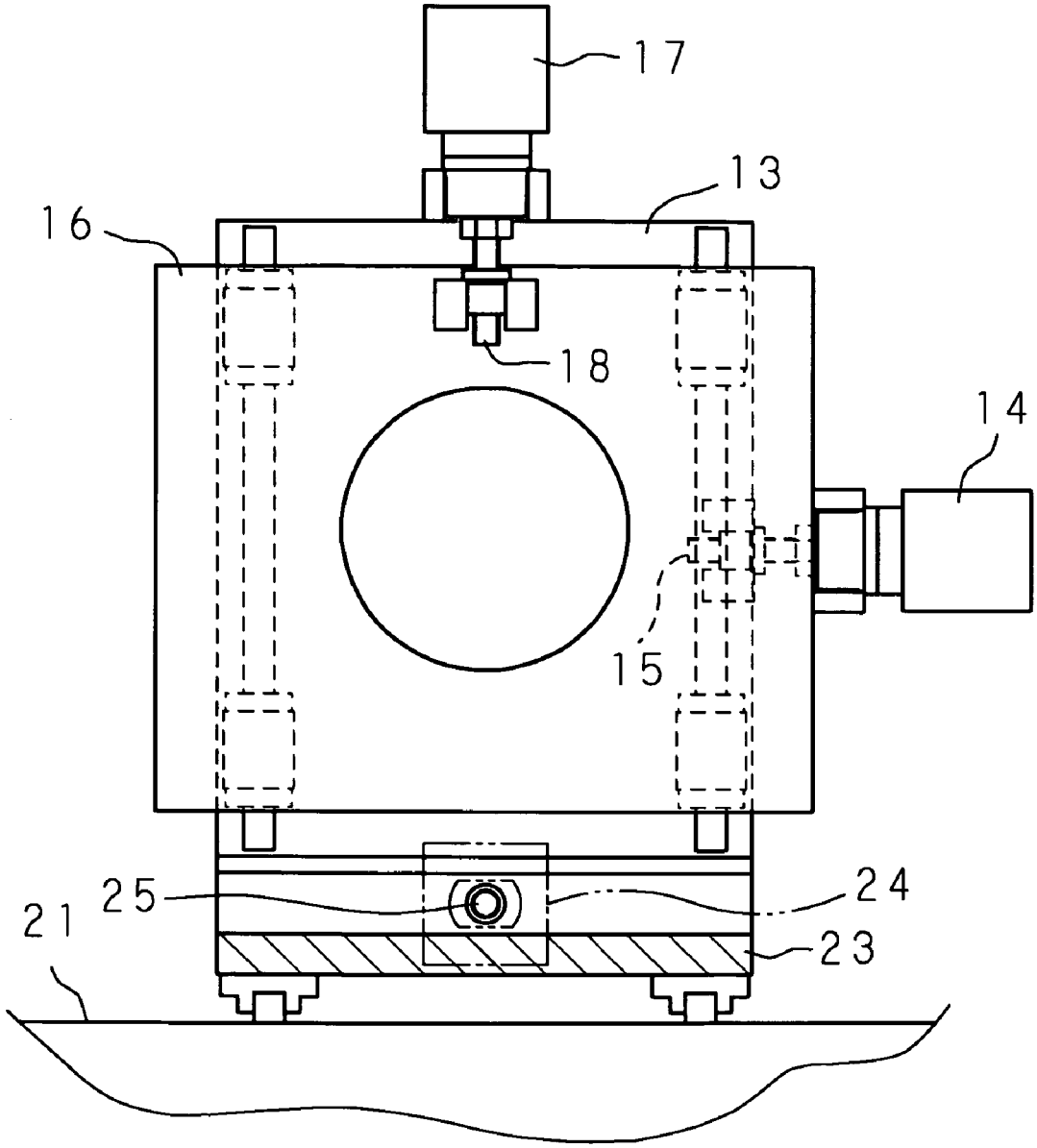
FIG. 6 is a cross sectional view taken along the VI-VI line in FIG. 4.

FIG. 4 is a cross sectional view taken along a vertical plane in the front-rear direction, including a wire feeding unit, and showing an essential structure of a coil spring manufacturing machine according to Embodiment 2, FIG. 5 is a front view showing the essential structure of the spring manufacturing machine according to Embodiment 2, and FIG. 6 is a cross sectional view taken along the VI-VI line in FIG. 4.

The coil spring manufacturing machine of Embodiment 2 feeds the wire 1 horizontally to the right in FIG. 4, that is, the front of the spring manufacturing machine, with the rotations of a pair of two upper and lower wire feeding rollers 7, 7 of the wire feeding unit 22 mounted on the base member 20 shown in FIG. 4. The wire 1 thus fed into the wire processing space 5 comes into contact with the shaping tools 12, 12, . . . (for example, bending dies) mounted on the ends of a plurality of shaping tool mounting members 11, 11, . . . placed to cross the direction of feeding the wire 1 at substantially right angles. The wire 1 is bent and deformed in desired directions, according to the angles of the shaping tools 12, 12, . . . in contact and their relative positional relationship, to bend and form a desired spring. Although Embodiment 2 illustrates an example including a plurality of shaping tool mounting members 11, 11, . . . , the coil spring manufacturing machine 1 may include at least one shaping tool mounting member 11.

The above-mentioned one or a plurality of shaping tool mounting members 11, 11, . . . are attached to the first plate member 13. The first plate member 13 is provided to be movable in a lateral direction of the housing of the coil spring manufacturing machine, that is, a horizontal direction (hereinafter referred to as the X-axis direction) crossing the direction of feeding the wire 1 at a substantially right angle, and comprises the servo motor 14 as a drive source. The rotation of the servo motor 14 is converted into linear motion in the X-axis direction of the first plate member 13 by the ball screw 15.

The first plate member 13 is attached to the second plate member 16 so that it is movable in the X-axis direction. The second plate member 16 is provided to be movable in a direction crossing the movable direction of the first plate member 13 at a substantially right angle, that is, a vertical direction (hereinafter referred to as the Y-axis direction) of the housing of the coil spring manufacturing machine, and comprises the servo motor 17 as a drive source. The rotation of the servo motor 17 is converted into linear motion in the Y-axis direction of the second plate member 16 by the ball screw 18.

The second plate member 16 is attached to a third plate member 23 so that it is movable in the Y-axis direction. The third plate member 23 is provided to be movable in a direction crossing the movable direction of the first plate member 13 and the second plate member 16 at substantially right angles, that is, in the front-rear direction (hereinafter referred to as the Z-axis direction) of the housing of the coil spring manufacturing machine, and comprises a servo motor 24 as a drive source. The rotation of the servo motor 24 is converted into linear motion in the Z-axis direction of the third plate member 23 by a ball screw 25.

The third plate member 23 is attached to the base member 20 so that it is movable in the Z-axis direction. The base member 20 is attached to the board 21 of the coil spring manufacturing machine, and has the wire feeding unit 22 attached near the center of the base member 20. Thus, the wire feeding unit 22 does not move, and it is possible to change the relative positions of the wire feeding unit 22 and the shaping tools 12, 12, . . . of the shaping tool mounting members 11, 11, . . . by moving the first plate member 13, the second plate member 16, and the third plate member 23 in the X-axis direction, the Y-axis direction, and the Z-axis direction, respectively.

Note that the mechanism for converting the rotation of the servo motor 14 into linear motion in the X-axis direction of the first plate member 13, the mechanism for converting the rotation of the servo motor 17 into linear motion in the Y-axis direction of the second plate member 16, and the mechanism for converting the rotation of the servo motor 24 into linear motion in the Z-axis direction of the third plate member 23 are not particularly limited, and any known conversion mechanisms may be used.

According to Embodiment 2, as described above, it is possible to provide the mechanism for movement in the front-rear direction on the front side of the housing of the coil spring manufacturing machine without the housing becoming larger in the front-rear direction, to adjust the positional relationship between the wire feeding unit 22 and the shaping tool mounting member 11. It is therefore possible to achieve a compact spring manufacturing machine.

According to Embodiment 1, as described above, the shaping tool mounting members are movable in the X-axis and Y-axis directions. According to Embodiment 2, as described above, the shaping tool mounting members are movable in the X-axis, Y-axis and Z-axis directions. The present information includes not only providing the shaping tool mounting member movable in two axis directions or three axis directions, but also arranging it to be movable in one axis direction, particularly in the Z-axis direction. In this case, it is also possible to provide the moving function member for adjusting the positional relationship between the wire feeding unit and the shaping tool mounting member on the front side of the housing for containing the wire feeding member, thereby producing the effect of avoiding the housing from becoming larger in the front-rear direction.

As this description may be embodied in several forms without departing from the spirit of essential characteristics thereof, the present embodiments are therefore illustrative and not restrictive, since the scope is defined by the appended claims rather than by the description preceding them, and all changes that fall within metes and bounds of the claims, or equivalence of such metes and bounds thereof are therefore intended to be embraced by the claims.

What is claimed is:

1. A coil spring manufacturing machine comprising:

a wire feeding unit for feeding a wire into a wire processing space where the wire is processed to form a coil spring;

a plurality of shaping tool mounting members provided to be capable of advancing into and retreating from the wire processing space;

a movable member having said plurality of shaping tool mounting members attached thereto, and provided to be capable of moving in a wire feeding direction; and a drive source for moving said movable member in the wire feeding direction, wherein said plurality of shaping tool mounting members are placed substantially perpendicular to the wire feeding direction and placed radially around the wire processing space, and relative positions of said wire feeding unit and said shaping tool mounting member in the wire feeding direction are adjusted followed by controlling an operation of said drive source.

2. A coil spring manufacturing machine comprising:

a wire feeding unit for feeding a wire into a wire processing space where the wire is processed to form a coil spring;

a plurality of movable members having a plurality of shaping tool mounting members attached to any one of said movable members, and provided to be capable of moving in a first direction and a second direction said shaping tool mounting members provided to be capable of advancing into and retreating from the wire processing space;

a first drive source for moving a first movable member of said plurality of movable members in the first direction; and a second drive source for moving a second movable member of said plurality of movable members in the second direction, wherein said plurality of shaping tool mounting members are placed substantially perpendicular to a wire feeding direction and placed radially around the wire processing space, relative positions of said wire feeding unit and said shaping tool mounting member are adjusted followed by controlling operations of said first drive source and second drive source; and the wire feeding direction is horizontal, the first direction is vertical, and the second direction is horizontal.

* * * * *